US011950661B1

(12) United States Patent
Dumenigo

(10) Patent No.: US 11,950,661 B1
(45) Date of Patent: Apr. 9, 2024

(54) SECUREMENT AND RELEASE DEVICE FOR WEBBING

(71) Applicant: Jayson Dumenigo, Canyon Country, CA (US)

(72) Inventor: Jayson Dumenigo, Canyon Country, CA (US)

( * ) Notice: Subject to any disclaimer, the term of this patent is extended or adjusted under 35 U.S.C. 154(b) by 0 days.

(21) Appl. No.: 18/130,912

(22) Filed: Apr. 5, 2023

(51) Int. Cl.
*A44B 11/00* (2006.01)
*A44B 11/10* (2006.01)

(52) U.S. Cl.
CPC ..... *A44B 11/10* (2013.01); *Y10T 24/4016* (2015.01)

(58) Field of Classification Search
CPC ..... Y10T 24/4079; Y10T 24/4077; Y10T 24/4072; Y10T 24/4086; Y10T 24/4019; Y10T 24/4016; A44B 11/06; A44B 11/12
See application file for complete search history.

(56) References Cited

U.S. PATENT DOCUMENTS 963,201 A * 7/1910 Arnold ..... A44B 11/10 24/321
3,591,995 A 7/1971 Troutner
3,676,901 A 7/1972 Monti
4,420,126 A 12/1983 Ando
4,717,088 A 1/1988 Fohl
5,335,371 A * 8/1994 Spessard ..... A63B 71/10 2/9
5,647,553 A 7/1997 Smithson et al.
7,506,413 B2 3/2009 Dingman et al.
8,935,833 B2 1/2015 Kaneko
9,656,591 B1 5/2017 Dumenigo et al.
11,096,452 B2 8/2021 Millard et al.
2004/0128802 A1 7/2004 Templeton
2014/0000067 A1* 1/2014 Hortnagl ..... B60P 7/0838 24/193
2019/0387844 A1 12/2019 Millward et al.

* cited by examiner

*Primary Examiner* — Jonathan Malikasim
*Assistant Examiner* — Michael S Lee

(57) ABSTRACT

A securement and release device for webbing (SRDFW) comprised of two design configurations. Both configurations of the SRDFW allow a length of webbing to be quickly and securely attached to or removed from a structure. Both designs essentially function as a quick secure/release device into which webbing is inserted. Both configurations of the SRDFW are comprised of a securing and release assembly having a first side member, a second side member, an upper jaw, a center wedge and a lower jaw. Pivot rods extend outward from the jaws and the wedge. The pivot rods allow the jaws and the wedge to pivot into an open configuration to allow webbing to be inserted into/through the first assembly, and then to pivot into a closed position that locks the webbing within the assembly. The jaws and wedge can then pivot to remove the webbing.

10 Claims, 11 Drawing Sheets

SECUREMENT AND RELEASE DEVICE FOR WEBBING

TECHNICAL FIELD

The invention generally pertains to securing webbing, and more particularly to asecurement and release device for webbing that facilitates the quick tightening or release of webbing on or around an item/object.

BACKGROUND ART

In order to secure certain items, for example, a stage/lighting truss, it is often preferable to use webbing which is typically made of nylon or a fabric. Webbing is usually stronger than a rope or similar item and as a result of webbing design it can lay flat on an item while a rope (or a chain) can not.

Webbing can be placed on/around an item manually or a ratcheting device can be used to provide an extremely tight, or high tension securement. There are problems that can be experienced when using webbing. Depending on what the webbing is used to secure, the process does require effort and can be time consuming, especially when a single person is placing the webbing. There is also a safety issue in that if webbing is not placed on an item correctly there could be a false sense that the item is adequately secured. This can be particularly problematic if webbing is used to secure an item that is elevated, such as on a stage where secured items are directly above people performing.

A solution to these problems would be to provide a device that would facilitate the quick and comparatively easy placing on and tightening of webbing onto an item or object. Optimally, a person would be able to use a length of conventional webbing to secure an item/object in a desired or required position. A device that could provide this functionality would greatly benefit many occupations that often rely on webbing for securement. There could be a reduction in the time required to secure items, especially when there is a significant number of items, and the level of safety could also be increased. In certain scenarios, when a webbing securement device is utilized, the entire process could have any difficulty reduced or even eliminated. Also, if a device can be utilized to quickly and easily release webbing that was previously secured, the benefit would be even greater.

A search of the prior art did not disclose any literature or patents that read directly on the claims of the instant invention. However, the following U.S. patents are considered related:

| Pat. No. | INVENTOR | ISSUED |
|---|---|---|
| U.S. Pat. No. 3,676,901 | Monti | Jul. 18, 1972 |
| U.S. Pat. No. 4,420,126 | Ando | Dec. 13, 1983 |
| U.S. Pat. No. 9,656,591 | Domenigo, et al | May 23, 2017 |
| U.S. Pat. No. 11,096,452 | Millard, et al | Aug. 24, 2021 |

The U.S. Pat. No. 3,676,901 patent discloses an adjustable, quickly releasable webbing connector having non-slip characteristics which make it particularly useful with webbing made of a slippery fibrous materials.

The U.S. Pat. No. 4,420,126 patent discloses a webbing lock device capable of winding and unwinding a webbing and comprising: a stationary clamp opposed to one surface of the webbing and close thereto; a movable clamp opposed to the other surface of the webbing; and a contact portion having wound thereon, with the webbing connected to the movable clamp member and movable to cause the movable clamp member to move toward the stationary clamp member. The deformable member being deformed or broken when the tension in the webbing exceeds a predetermined value, whereby forces applied to the webbing by the stationary and movable clamp members are restricted.

The U.S. Pat. No. 9,656,591 patent discloses a securing strap having at least two strap securing interfaces that functions in combination with a ratcheting device. A first end of the strap is looped around a strap attachment rod on the ratcheting device and extends back over a section of the strap allowing the two strap sections to be attached. Along the two attached strap sections, attachment means are used to create openings, into which at least two strap securing intervals and at least one strap securing member are inserted when securing an object. The two securing interfaces and the at least one securing member cause the strap to remain in place even if the ratcheting device fails.

The U.S. Pat. No. 11,096,452 patent discloses a web-adjustment clamp that includes a main body with a first lateral channel, a second lateral channel, a fold channel, and an exit channel. The channels are configured to accept, have passed through, and retain a first webbing. The fold channel may be further configured to accept, have passed through, and retain a second webbing. A locking door is pivotally coupled to the main body and moves between an open position and a closed position. The first webbing is adjustable when the locking door is in the open position, and locked in the closed position.

For background purposes and indicative of the art to which the invention relates, reference may be made to the following remaining patents found in the patent search.

| Pat. No. | INVENTOR | ISSUED |
|---|---|---|
| U.S. Pat. No. 3,591,995 | Troutner | Jul. 13, 1971 |
| U.S. Pat. No. 4,717,088 | Fohl | Jan. 5, 1988 |
| U.S. Pat. No. 5,647,553 | Smithson, et al | Jul. 15, 1997 |
| U.S. Pat. No. 7,506,413 | Dingman, et al | Mar. 24, 2009 |
| U.S. Pat. No. 8,935,833 | Kaneko | Jan. 20, 2015 |
| 2019/0387844 | Millward, et al | Dec. 26, 2019 |
| 2004/0128802 | Templeton | Jul. 8, 2004 |

DISCLOSURE OF THE INVENTION

A securement and release device for webbing (SRDFW) that is comprised of two design configurations. Both configurations of the SRDFW allow a length of webbing to be quickly and securely attached to a structure such as a truss. The SRDFW also allows secured webbing to be easily removed. Both designs essentially function as a quick secure/release clamp into which a length of webbing is inserted and then maintained within the clamp for whatever amount of time is desired or required.

The first design configuration of the SRDFW is comprised of a first securing and release assembly having a first side member, a second side member, an upper jaw, a center wedge and a lower jaw. Pivot rods extend outward from side edges of the two jaws and the center wedge. The pivot rods from the jaws extend outward from the two side members through pivot rod openings on each side member. The center wedge pivot rod extends outward from the two side members through an angled slot in each side member. A spring-loaded retaining clip maintains the center wedge pivot rod within the slot. The pivot rods allow the two jaws and the center wedge to pivot into either an open configuration to allow a length of webbing to be inserted into/through the first assembly, and then to pivot into a position that closes and locks the webbing in place within the assembly. The two jaws and center wedge can then pivot back to the open configuration to remove the webbing from the SRDFW.

The second design configuration of the SRDFW is similar to the first configuration and is comprised of a second securing and release assembly having a first side member, a second side member, an upper jaw, a center wedge, and a lower jaw. The major difference between the first configuration and the second configuration is that the center wedge pivot rod slot is horizontally configured, as opposed to angled and the second configuration does not utilize a spring-loaded retaining clip to maintain the center wedge pivot rod within the slot. Also the center wedge pivot rod can be removable from the center wedge by sliding the pivot rod out via a pivot rod opening that extends through the center wedge from one side edge to the other side edge.

In order to secure webbing within the SRDFW, one end of a length of webbing is inserted into the assembly from the front, below the upper jaw and along the upper surface of the center wedge. The webbing continues around the rear edge of the center edge, with the rear edge being rounded to allow smooth movement of the webbing around the rear edge. The webbing continues outward toward the front of the assembly between the lower surface of the center edge and the upper surface of the lower jaw. When the webbing is pulled, the upper and lower jaws, and center wedge, pivot to a position that locks the webbing within the SRDFW.

In view of the above disclosure the primary object of the invention is to provide a securement and release device for webbing that allows the quick and secure maintaining of a length of webbing that is attached onto an item or object, and to allow secured webbing to be quickly removed.

In addition to the primary object, it is also an object of the invention to provide a securement and release device for webbing that:

- is easy to use,
- can be used with various types of webbing,
- does not damage, or interfere with the function of webbing in any way,
- can be set-up by a single person,
- is durable and long-lasting,
- can be sold along with a length of webbing or as a stand-alone product,
- can increase safety when using webbing.
- requires no or minimal maintenance,
- can be used numerous times over an extended period of time, and
- is cost effective from both a manufacturer's and consumer's point of view.

These and other objects and advantages of the present invention will become apparent from the subsequent detailed description of the preferred embodiment and the appended claims taken inconjunction with the accompanying drawings.

BEST MODE FOR CARRYING OUT THE INVENTION

The best mode for carrying out the invention is presented in terms that disclose a preferred embodiment with two design configurations of a securement and release device for webbing (SRDFW). There are many scenarios in which an object such as a stage truss must be secured in an operable or required location/position. One method of accomplishing this is by using webbing (either nylon or fabric) which is wrapped around the object and then either manually or assisted by a ratcheting device tightened to hold the object in the required location/position. While the method of using webbing is effective it can be difficult to perform and time-consuming. There is also a concern if webbing is not properly secured around an object and adequately tightened there could be safety issues.

Figure 1:
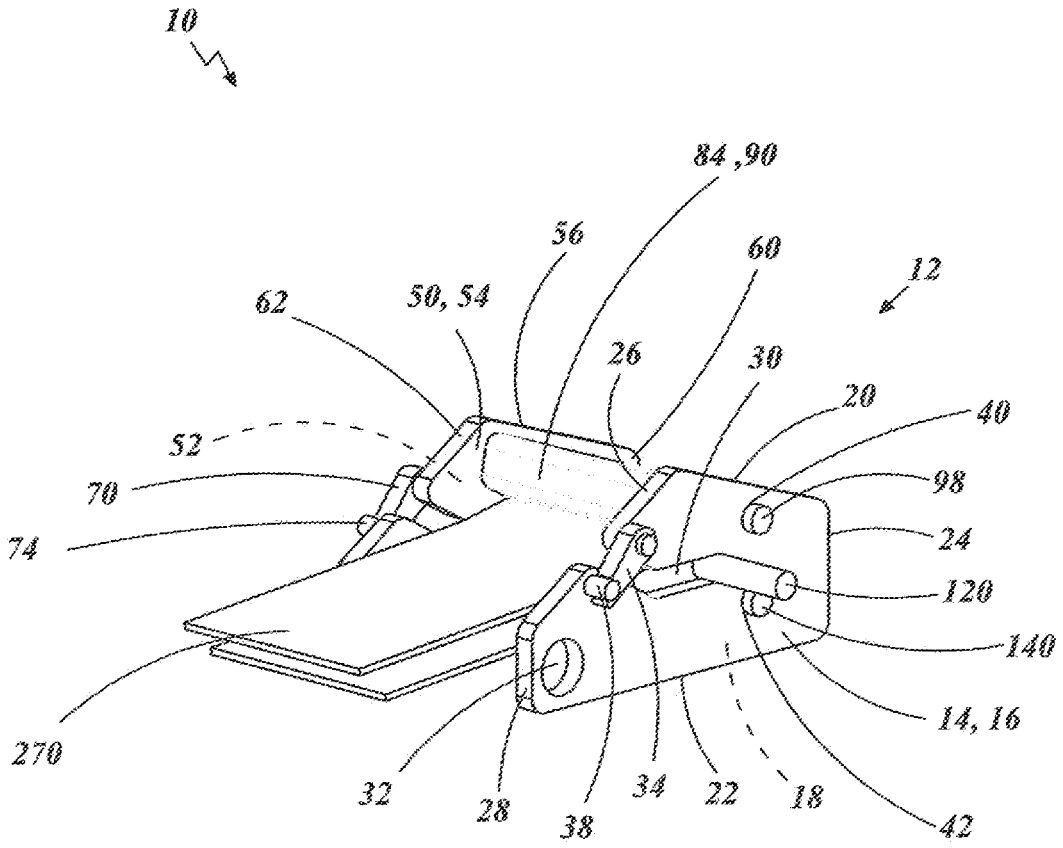
FIG. 1 is a rear orthographic view showing a first design configuration of a securement and release device for webbing (SRDFW) with a length of webbing in a functional position within the SRFDW.
Figure 2:
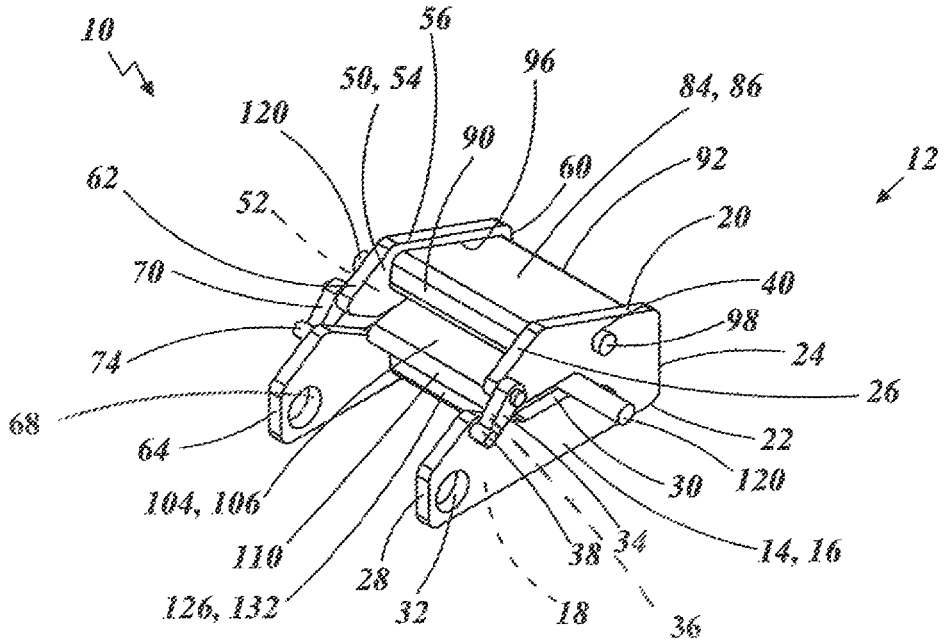
FIG. 2 is a rear orthographic view showing a first design configuration of the SRDFW.
Figure 3:
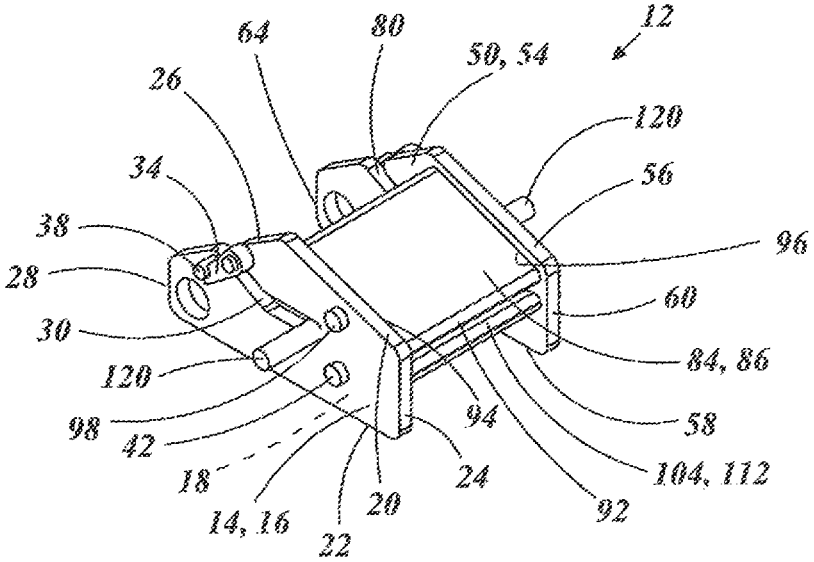
FIG. 3 is a front orthographic view showing a first design configuration of the SRDFW.
Figure 4:
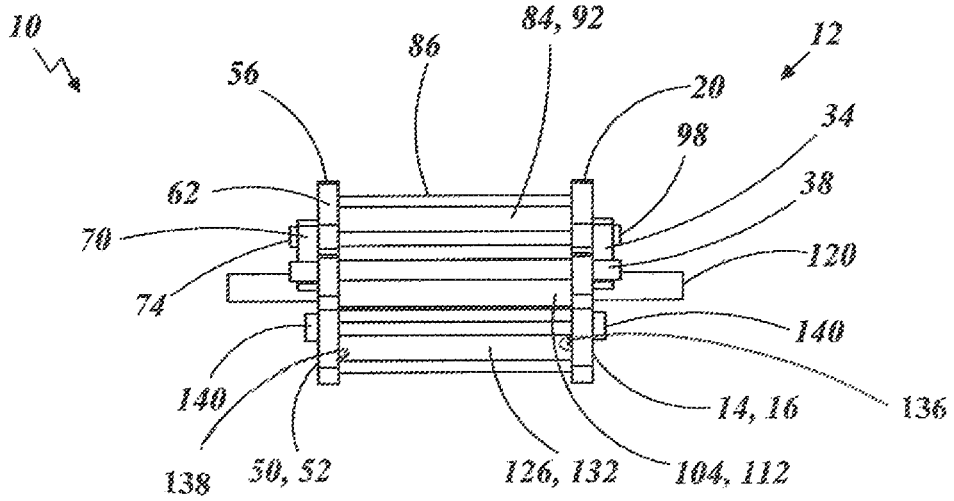
FIG. 4 is a rear elevational view showing a first design configuration of the SRDFW.
Figure 5:
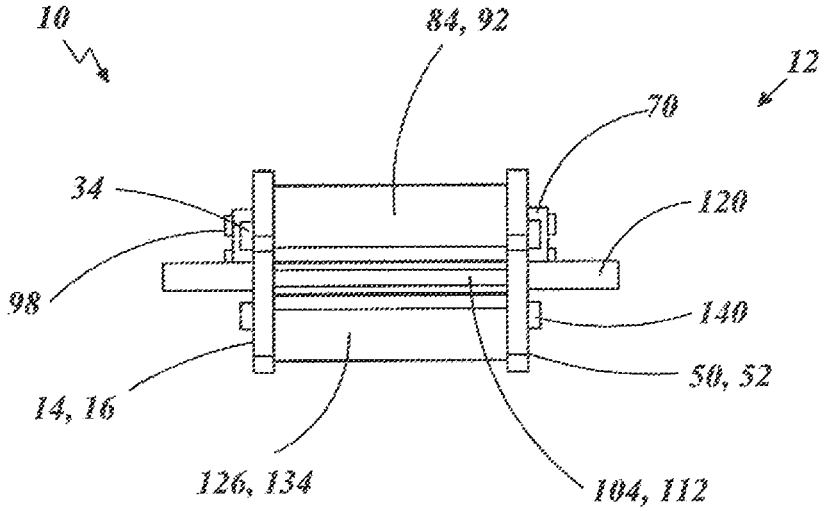
FIG. 5 is a front elevational view showing the first design configuration of the SRDFW.
Figure 6:
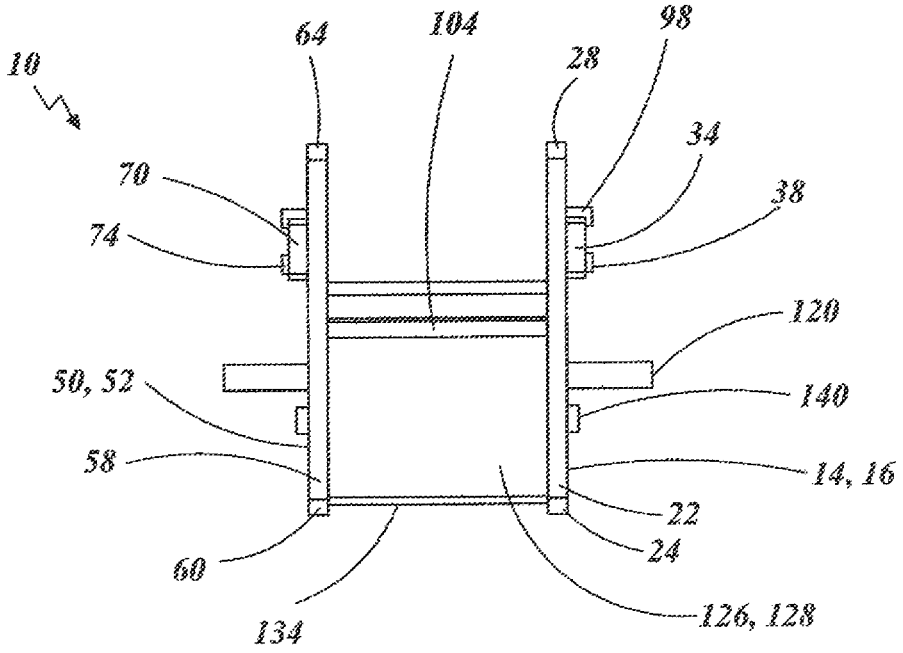
FIG. 6 is a bottom plan view showing the first design configuration of the SRDFW.
Figure 7:
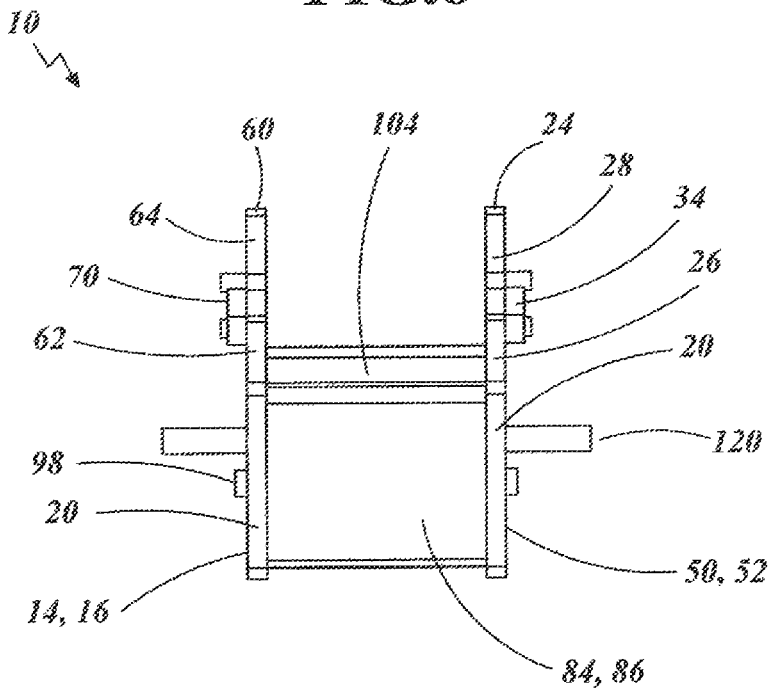
FIG. 7 is a top plan view showing the first design configuration of the SRDFW.
Figure 8:
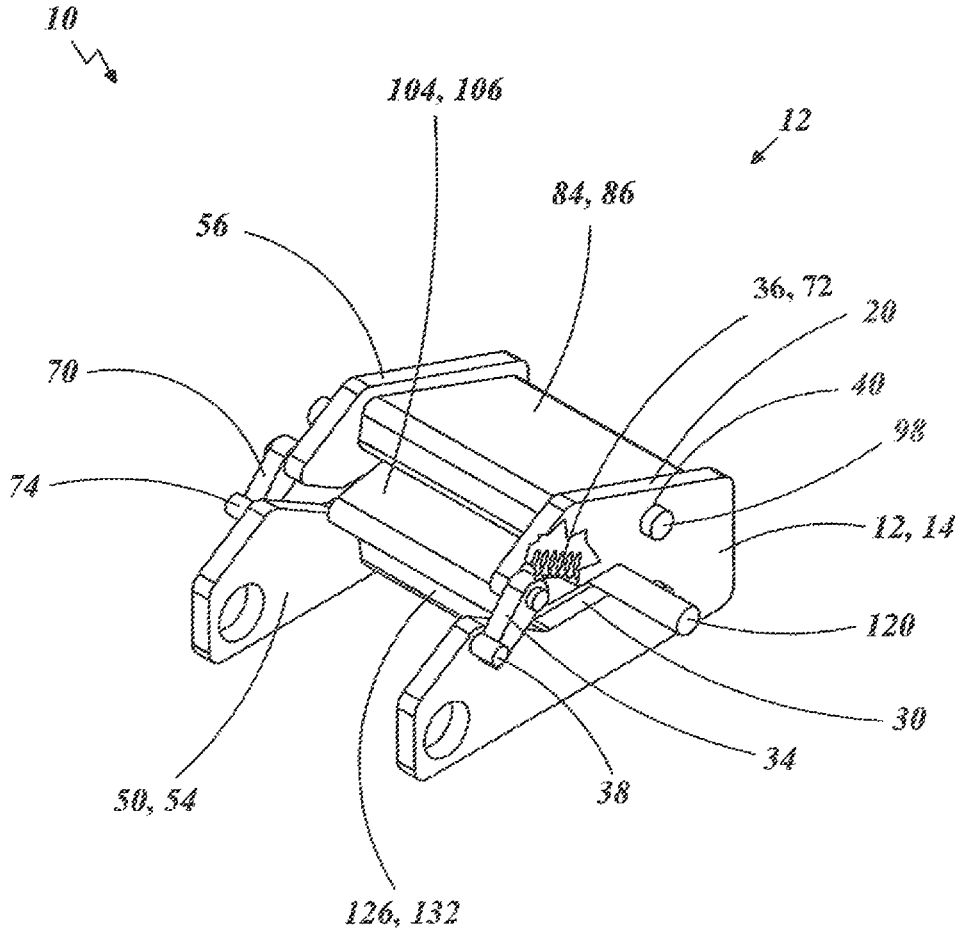
FIG. 8 is a rear orthographic view showing the design configuration of the SRDFW with a cut-away section in a first side member showing a clip spring that maintains a retaining clip in a closed position over a slot.
Figure 9:
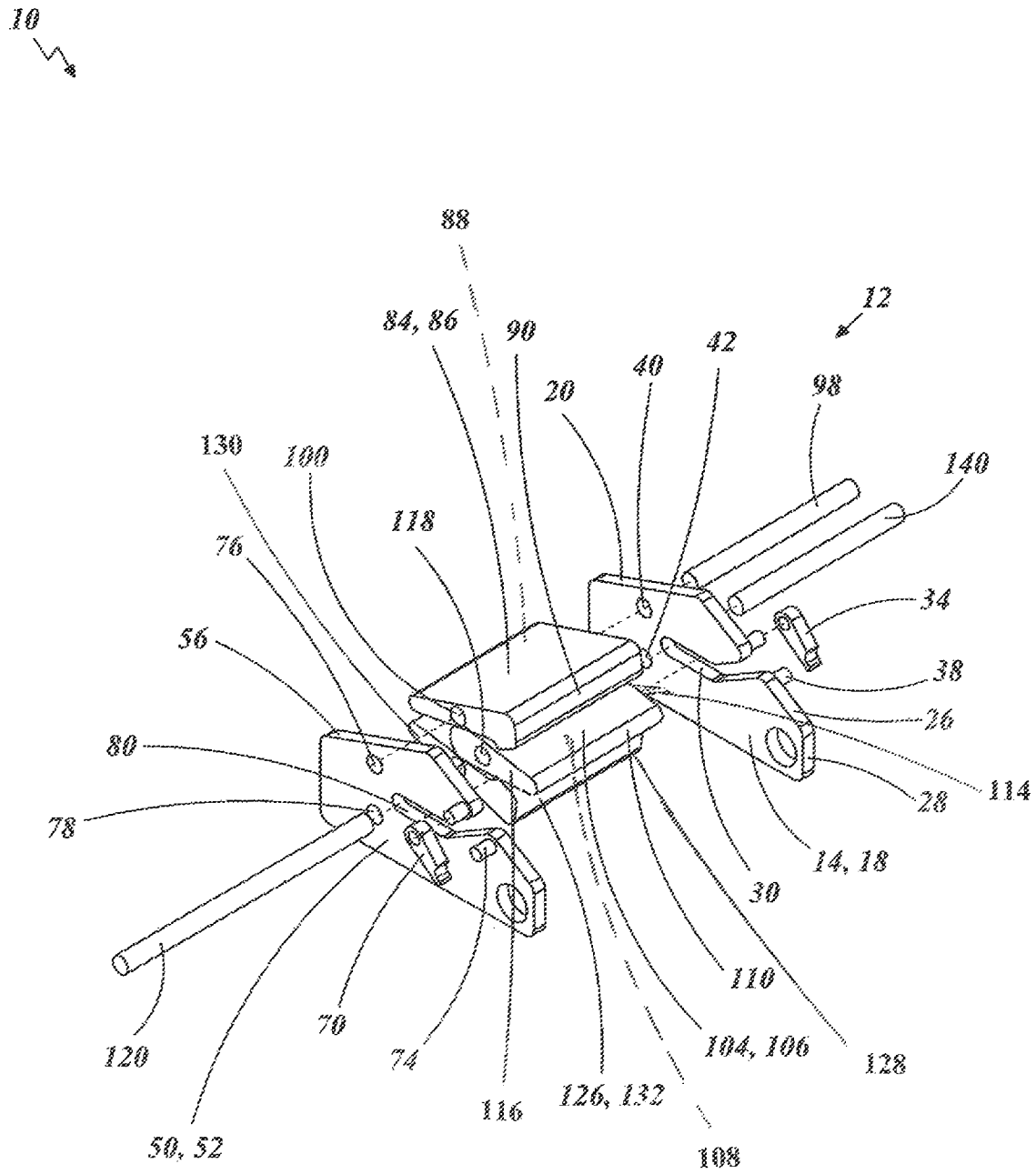
FIG. 9 is an exploded view showing the separated elements of the first design configuration of the SRDFW.
Figure 10:
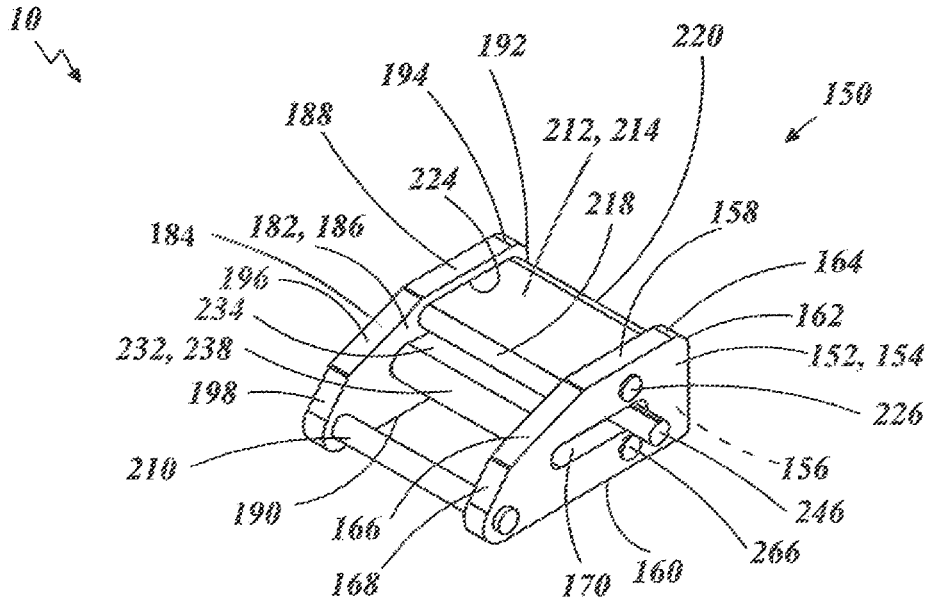
FIG. 10 is a rear orthographic view showing a second design configuration of the SRDFW.
Figure 11:
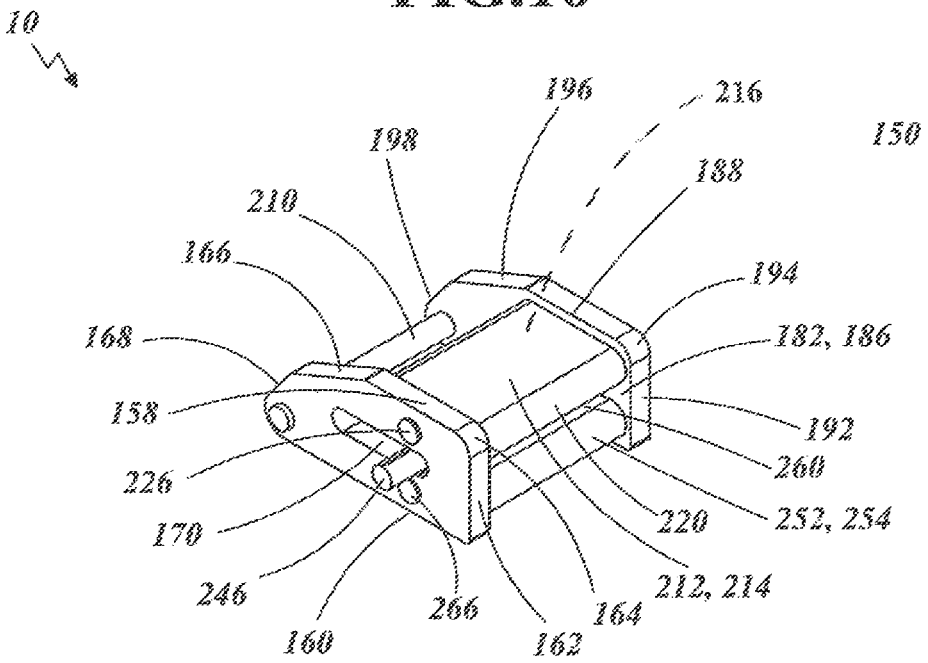
FIG. 11 is a front orthographic view showing a second design configuration of the SRDFW.
Figure 12:
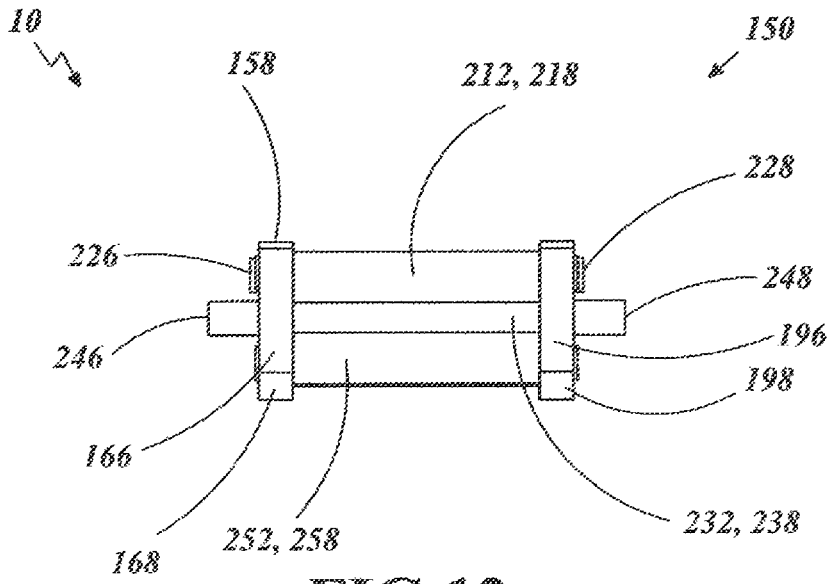
FIG. 12 is a rear elevational view showing a second design configuration of the SRDFW.
Figure 13:
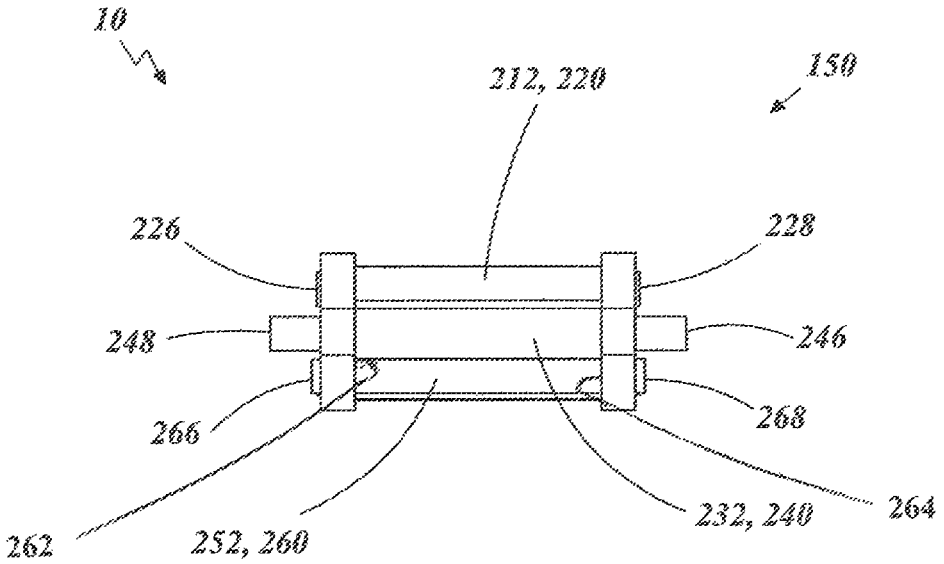
FIG. 13 is a front elevational view showing a second design configuration of the SRDFW.
Figure 14:
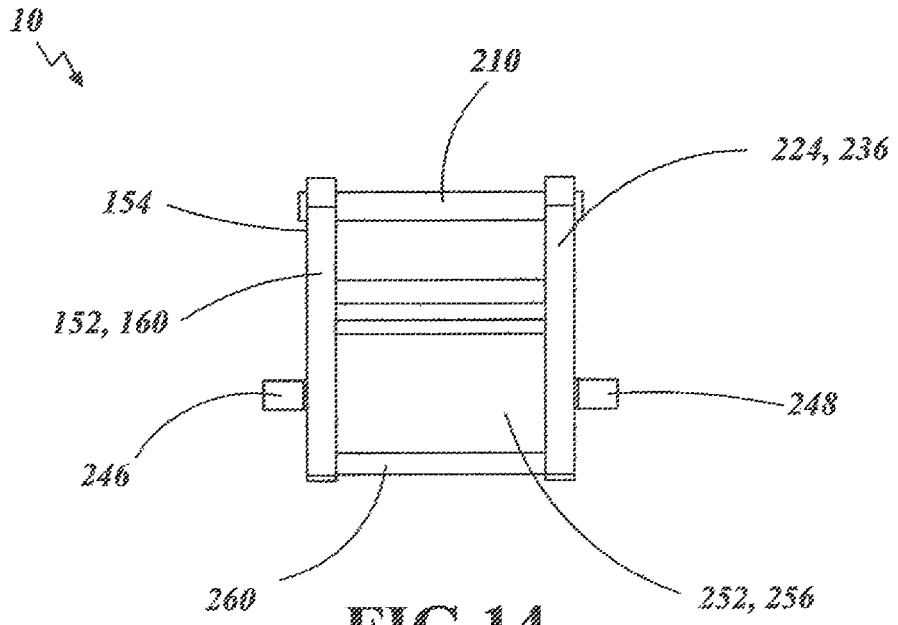
FIG. 14 is a bottom plan view showing a second design configuration of the SRDFW.
Figure 15:
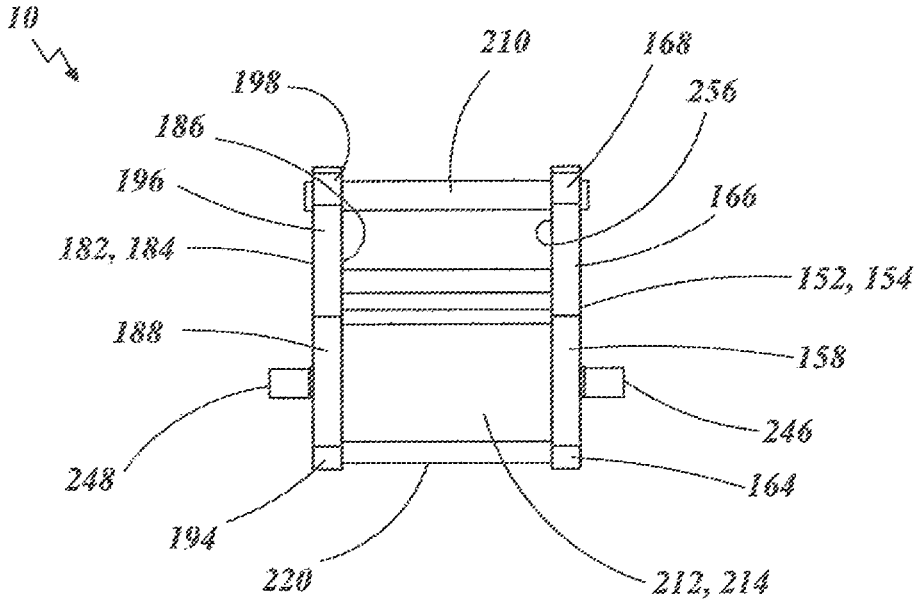
FIG. 15 is a top plan view showing a second design configuration of the SRDFW.
Figure 16:
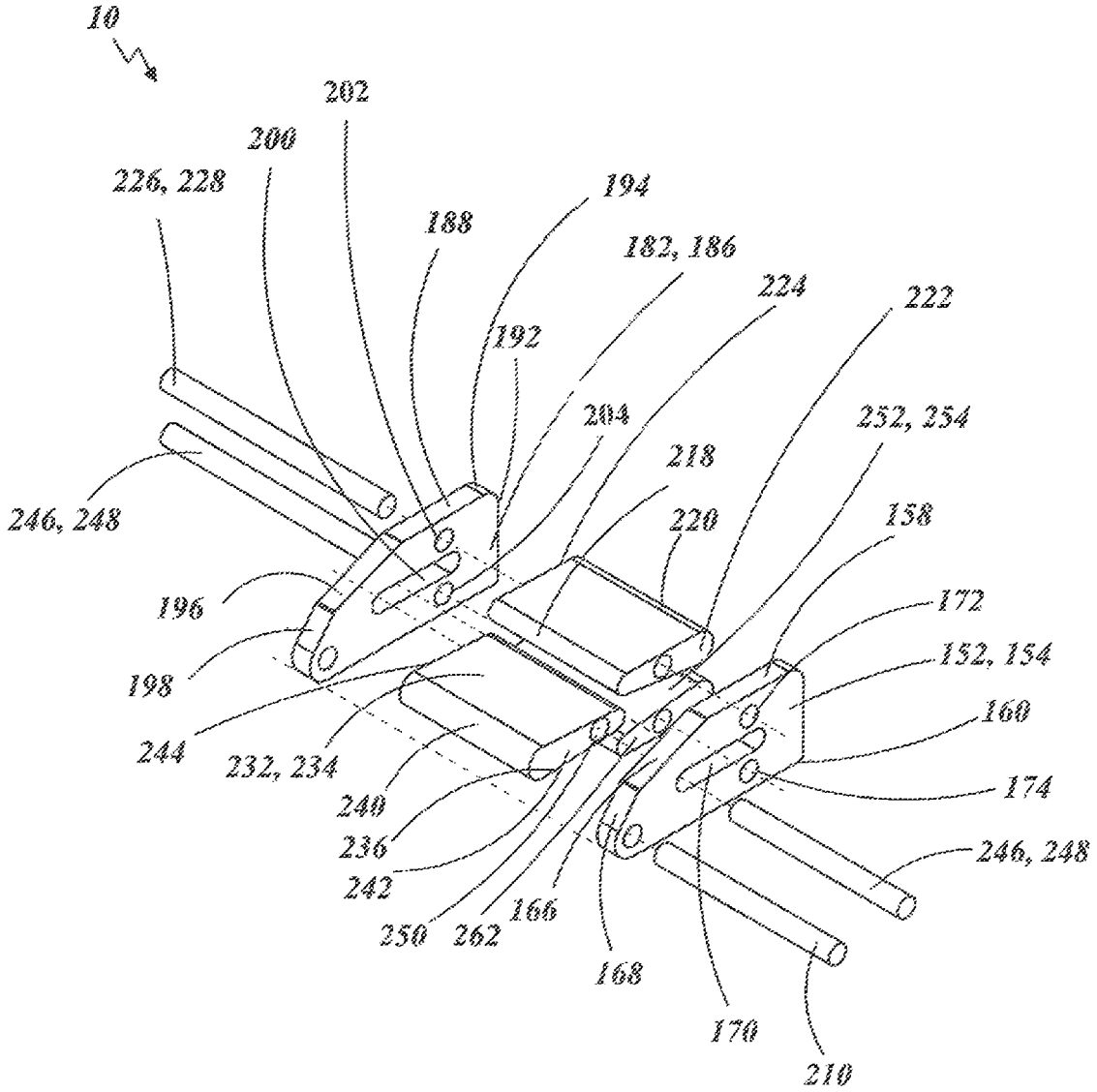
FIG. 16 is an exploded view showing the separated elements of the second design configuration of the SRDFW.
Figure 17:
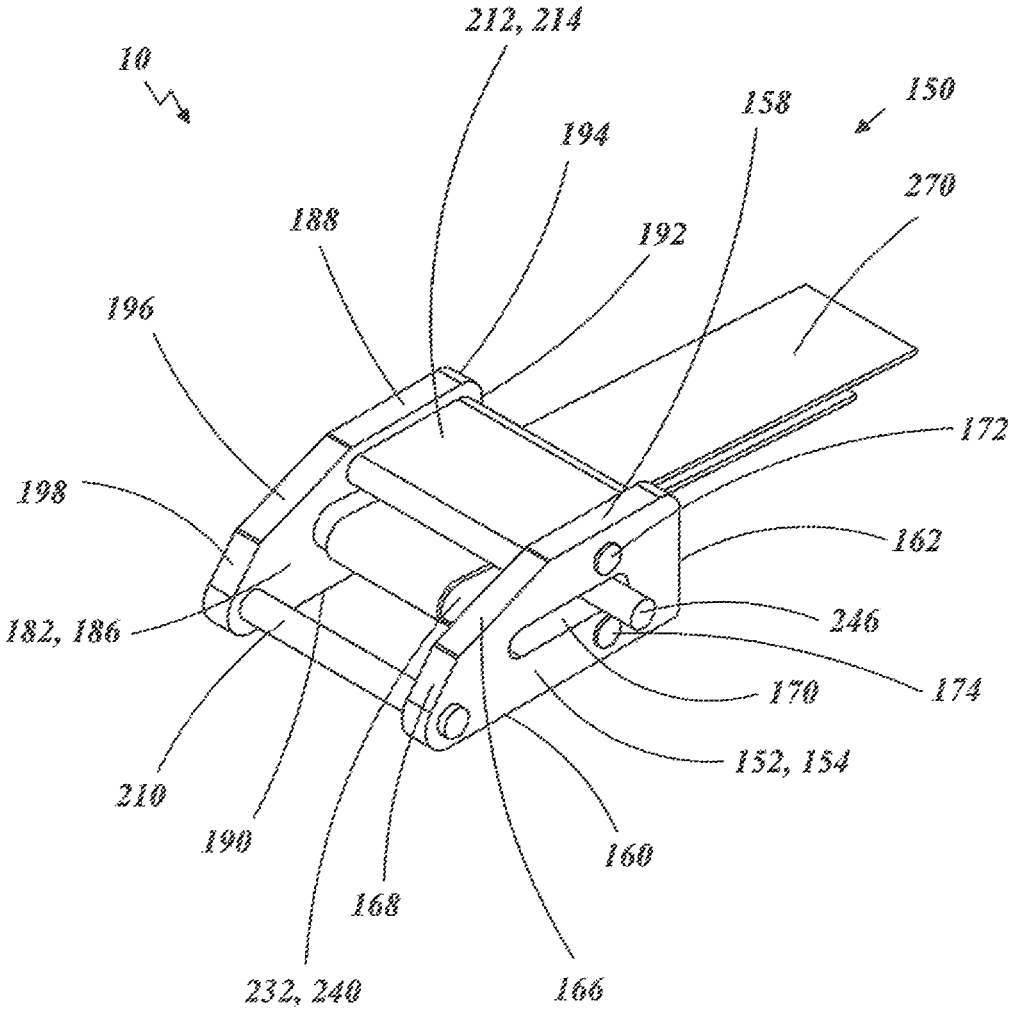
FIG. 17 is a front orthographic view showing the second design configuration of the SRDFW with a length of webbing in a functional position within the SRDFW.

The SRDFW 10, as shown in FIGS. 1-17, provides a means by which a length of webbing can be quickly and correctly secured around an object, and released when necessary. The first design configuration of the SRDFW 10, as shown in FIGS. 1-9, is comprised of the following major elements: a first securing and release assembly 12 comprising a first side member 14, a second side member 50, an upper jaw 84, a center wedge 104, and a lower jaw 126. The first side member 14 has an outer surface 16, a inner surface 18, an upper edge 20, a lower edge 22, a front vertical edge 24, a rear angled edge 26, a rear vertical edge 28, a curved slot 30, a web attachment opening 32, a retaining clip 34 that preferably utilizes a clip spring 36 and a clip stop 38 to maintain the retaining clip 34 in a position that closes the slot 30 while also allowing the retaining clip 34 to be manually placed in a position that opens the slot 30 and then forces the retaining clip 34 back into the closed slot position when released, an upper pivot rod opening 40, and a lower pivot rod opening 42.

The second side member 50 is configured parallel to the first side member 14 and also has an outer surface 52, an inner surface 54, an upper edge 56, a lower edge 58, a front vertical edge 60, a rear angled edge 62, a rear vertical edge 64, a curved slot 80, a web attachment opening 68, a retaining clip 70 that preferably utilizes a clip spring 72 and a clip stop 74 to maintain the retaining clip 70 in a position that closes the slot 80 while also allowing the retaining clip 70 to be manually placed in a position that opens the slot 80 and then forces the retaining clip 70 back into the closing slot position when released, an upper pivot rod opening 76, and a lower pivot rod opening 78.

The upper jaw 84, as shown in FIGS. 1-5 and 7-9, is located adjacent and below the upper edge 20, 56 of the two parallel side members 14,50, and includes an upper surface 86, a lower surface 88, a front edge 90, a rear edge 92, a first side edge 94, a second side edge 96 and a pivot rod 98 that extends outward from the two side edges 94,96 and through the respective upper pivot rod openings 40,76 on the two side members 14,50. As its name implies, the pivot rod 98 facilitates the upward and downward pivoting of the upper jaw 84 when the upper jaw is located between the two side members 14,50.

As shown in FIGS. 1, 2, 4, 5, 8 and 9, located below the upper jaw 84 is the center wedge 104 which has an upper surface 106, a lower surface 108, an upper front edge 110, a rear edge 112 that is rounded to allow webbing to easily slide about the rear edge 112, a first side edge 114, a second side edge 116, a pivot rod bore 118 extending through the center wedge 104 from the first side edge 114 to the second side edge 116, and a pivot rod 120 that is inserted through the pivot rod bore 118 while also being removable. The pivot rod 120 allows the center wedge 104 to pivot upward and downward when the center wedge 104 is located between the two side members 14,50 within the assembly 12.

The lower jaw 126, as shown in FIGS. 1-6, 8 and 9, is located below the center wedge 104 adjacent to ther lower edges 22,58 of the two side members 14,50 and has an outer surface 128, an inner surface 130, a front edge 132, a rear edge 134, a first side edge 136, a second side edge 138 and a pivot rod 140 that like the pivot rod 98 on the upper jaw, extends outward from the two side edges 136,138, and through the respective lower pivot rod openings 42,78 on the side members 14,50. The pivot rod facilitates the upward and downward pivoting of the lower jaw 126 when the lower jaw is located between the two side members 14,50.

In order to use the first design configuration of the SRDFW 10, one end of a length of webbing is inserted into the assembly 12 from the front, below the upper jaw along the upper surface of the center wedge. The webbing continues around the rear rounded edge and then outward toward the front of the assembly between the lower surface of the center wedge and the upper surface of the lower jaw. When the webbing is pulled, the upper and lower jaws and the center wedge pivot into a position that locks the webbing within the assembly.

The second design configuration of the SRDFW 10, as shown in FIGS. 10-17, is comprised of the following major elements: s second securing and release assembly 150 having a first side member 152, a second side member 182, an upper jaw 212, a center wedge 232, and a lower jaw 252. The second design configuration is structurally and functionally similar to the first design configuration with a couple of structural differences.

The first side member 152, as shown in FIGS. 10-17, includes an outer surface 154, an inner surface 156, an upper edge 158, a lower edge 160, a front vertical edge 162, a front rounded corner 164, a rear upper angled edge 166, a rear lower angled edge 168, a slot 170 that is horizontally configured in the side member 152, an upper pivot rod opening 172, a lower pivot rod opening 174, and a rear pivot rod opening 176.

The second side member 182, shown in FIGS. 10-17, is configured parallel to the first side member 152 and also has an outer surface 184, an inner surface 186, an upper edge 188, a lower edge 190, a front vertical edge 192, a front rounded corner 194, a rear upper angled edge 196, a rear lower angled edge 198, a slot 200 that is horizontally configured in the side member 182, an upper pivot rod opening 202, and a lower pivot rod opening 204.

The upper jaw 212, as shown in FIGS. 10-13 and 15-17, is located between the two parallel side members 152,182 below the upper edges 158,188 of the side members and has an upper surface 214, a lower surface 216, a front edge 218, a rear edge 220, a first side edge 222, a second side edge 224, and a pivot rod 226 that extends outward from the side edges 222,224 and into the respective upper pivot rod openings 172,202 on each side member 152,182.

The center wedge 232 as shown in FIGS. 10, 13, 16 and 17, is located below the upper jaw 212 and has an upper surface 234, a lower surface 236, a front edge 238, a rear edge 240 that is rounded to allow webbing to easily slide about the rear edge, a first side edge 242, a second side edge 244, a first pivot rod 246 that extends outward from the first side edge 242 and through the slot 170 on the first side member 152, and a second pivot rod 248 that extends outward from the second side edge 244 and through the slot 200 on the second side member 182. It should be noted the two pivot rods 246,248 are integrally attached to the center wedge 232 and therefore a single, removable pivot rod, as in the first securing and release assembly does not exist in the second securing and release assembly.

The lower jaw 252, as shown in FIGS. 10-14, 16 and 17, is located below the center wedge 232 adjacent the lower edges 160,190 of the two side members 152,182, and has an upper surface 254, a lower surface 256, a front edge 258, a rear edge 260, a first side edge 262, a second side edge 264, a first pivot rod 266 extending outward from the first side edge 262 and through the lower pivot rod opening 174 on the first side member 152, and a second pivot rod 268 that extends outward from the second side edge 264 and through the lower pivot rod opening 204 on the second side member 182. In order to use the second design configuration the same steps are followed as for the first design configuration.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A securement and release device for webbing (SRDFW) comprising:

a first securing and release assembly comprising:

a first side member having:

an outer surface, an inner surface, an upper edge, a front vertical edge, a rear vertical edge, a slot,
a web attachment opening,
a retaining clip with an internal clip spring,
a clip stop,
an upper pivot rod opening,
a lower pivot rod opening,
a second side member having:
an outer surface,
an inner surface,
an upper edge,
a lower edge
a front vertical edge,
a rear angled edge,
a rear vertical edge,
a slot,
a web attachment opening,
a retaining clip with an internal clip spring,
a clip stop,
an upper pivot rod opening,
a lower pivot rod opening,
an upper jaw comprising:
an upper surface,
a lower surface
a front edge,
a rear edge,
a first side edge,
a second side edge,
a pivot rod that is configured to extend outward from the first and second side edges and through the upper pivot rod openings,
a center wedge having:
an upper surface,
a lower surface,
a front edge,
a rear rounded edge,
a first side edge,
a second side edge,
a pivot rod bore,
a pivot rod that extends outward from the first and second side edge and through the slots on each side member, with the retaining clip configured to maintain the wedge pivot rod within the slot or align the pivot rod and wedge to be rearward from the first securing and release assembly,
a lower jaw comprising:
an outer surface,
an inner surface,
a front edge,
a rear edge,
a first side edge,
a second side edge, and
a pivot rod that is configured to extend outward from the first and second side edges and through the lower pivot rod openings, with one end of a length of webbing inserted into the first assembly from the front below the upper jaw, along the upper surface of the center wedge, the webbing continues around the rear rounded edge and then outward toward the front of the first assembly between the lower surface of the center wedge and the upper surface of the lower jaw, and when the webbing is pulled, the upper and lower jaws and center wedge pivot to a position that locks the webbing within the SRDFW.

2. The securement and release device for webbing of claim 1, wherein the SRDFW is made of plastic.

3. The securement and release device for webbing of claim 1, wherein the SRDFW is made of metal.

4. The securement and release device for webbing of claim 1, wherein the SRDFW is made of a composite material.

5. The securement and release device for webbing of claim 1, wherein the webbing is comprised of woven, nylon webbing.

6. The securement and release device for webbing of claim 1, wherein the webbing is comprised of fabric webbing.

7. The securement and release device for webbing of claim 1, wherein the upper jaw pivot rod is integral with the upper jaw.

8. The securement and release device for webbing of claim 1, wherein the center wedge pivot rod is integral with the center wedge.

9. The securement and release device for webbing of claim 1, wherein the center wedge pivot rod is inserted through the centrer wedge pivot rod bore, thereby allowing the pivot rod to also be extracted from the pivot rod bore, allowing the center wedge to be removed from the SRDFW.

10. The securement and release device for webbing of claim 1, wherein the slots on the first and second side members are in a substantially curved configuration, allowing the center wedge pivot rod to slide downward into a functional position.

* * * * *